United States Patent [19]

Giovagnoli

[11] Patent Number: 5,056,782

[45] Date of Patent: Oct. 15, 1991

[54] BALL RETURN CONVEYOR SYSTEM FOR BASEBALL PITCHING MACHINE CAGES

[75] Inventor: Paul S. Giovagnoli, Kansas City, Mo.

[73] Assignee: Master Pitching Machine, Inc., Kansas City, Mo.

[21] Appl. No.: 492,288

[22] Filed: Feb. 28, 1990

Related U.S. Application Data

[63] Continuation of Ser. No. 250,520, Sep. 29, 1988, abandoned.

[51] Int. Cl.[5] ..... A63B 69/00; B65G 15/00

[52] U.S. Cl. ..... 273/26 R; 273/26 D; 273/395; 198/803.15; 198/804; 198/841

[58] Field of Search ..... 273/26 R, 26 D, 29 R, 273/29 A, 176 K, 182 R, 182 A, 395, 47–49, 122 R, 125 R, 127 C; 198/803.14, 803.15, 804, 841, 842, 778; 124/7, 41 R

[56] References Cited

U.S. PATENT DOCUMENTS

| | | | |
|---|---|---|---|
| 2,011,146 | 8/1935 | Evans | 273/176 X |
| 2,096,105 | 10/1937 | Griffith | 198/803.19 |
| 2,630,322 | 3/1953 | Endriss | 273/49 X |
| 3,131,801 | 5/1964 | Marchetti | 198/804 |
| 3,184,239 | 5/1965 | Heuser | 273/49 X |
| 3,231,065 | 1/1966 | Kainski | 198/803.14 |
| 3,329,432 | 7/1967 | Pratt | 273/395 |
| 3,602,506 | 8/1971 | Gentiluomo | 273/182 R X |
| 3,623,065 | 11/1971 | Rockwood et al. | 273/395 X |
| 3,652,089 | 3/1972 | O'Conner | 273/395 |
| 3,812,953 | 5/1974 | Maschke | 198/803.15 X |
| 3,964,800 | 6/1976 | Grimes et al. | 198/841 X |
| 4,130,281 | 12/1978 | Leber et al. | 273/395 X |
| 4,611,809 | 9/1986 | Gettelfinger | 273/176 H |

FOREIGN PATENT DOCUMENTS

| | | | |
|---|---|---|---|
| 204722 | 4/1956 | Australia | 198/804 |
| 272063 | 6/1927 | United Kingdom | 198/804 |

*Primary Examiner*—Edward M. Coven
*Assistant Examiner*—Sebastiano Passaniti
*Attorney, Agent, or Firm*—Hovey Williams Timmons & Collins

[57] ABSTRACT

A ball return assembly for use with a pitching machine in a batting cage includes a conveyor having an endless loop belt with a transport surface provided with a plurality of spaced depressions each adapted to receive a ball. The belt is supported and guided along a generally horizontal ball return path to permit balls in the batting cage to be returned to the pitching machine.

11 Claims, 2 Drawing Sheets

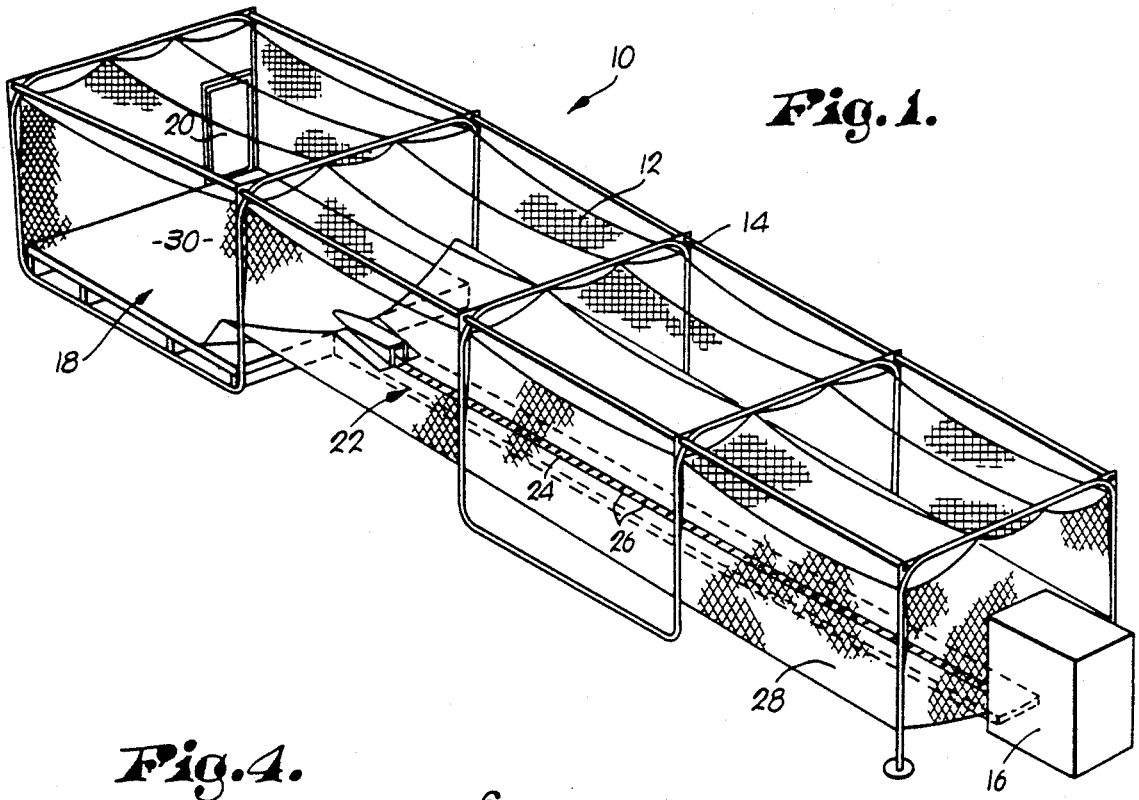
Fig. 1.
Fig. 4.
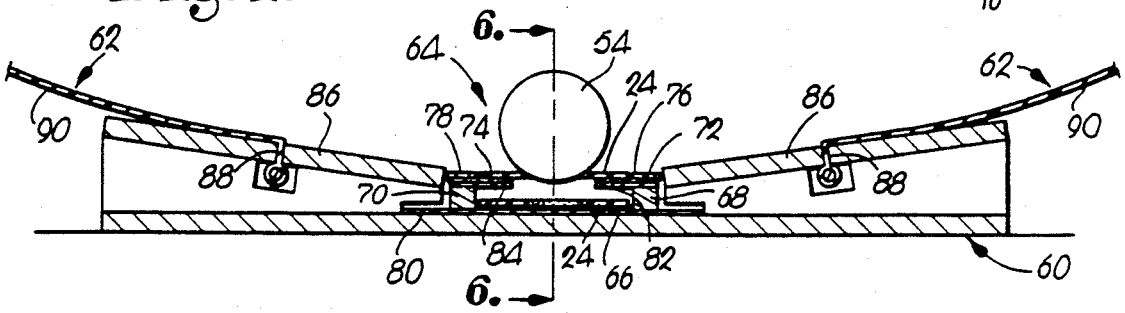
Fig. 5.
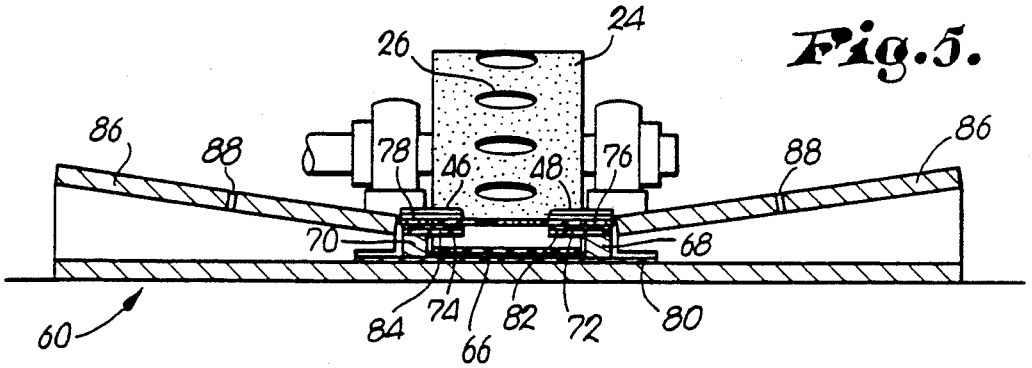
Fig. 6.
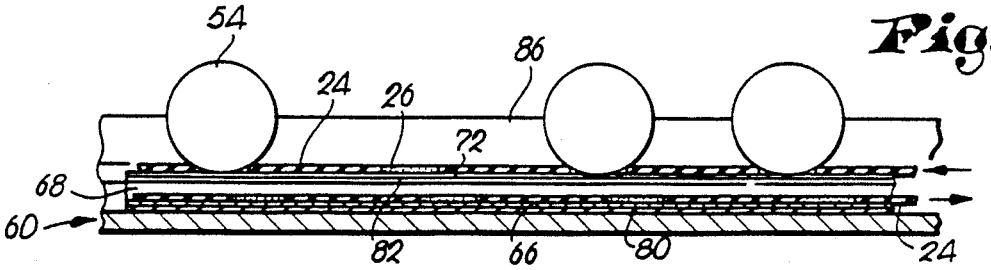

BALL RETURN CONVEYOR SYSTEM FOR BASEBALL PITCHING MACHINE CAGES

This application is a continuation of application Ser. No. 250,520, filed Sept. 29, 1988, and now abandoned.

BACKGROUND OF THE INVENTION

1. Field of the Invention

The present invention relates generally to conveyors and, more particularly, to a ball return conveyor assembly for use with a pitching machine in a batting cage.

2. Description of the Prior Art

Various ball pitching machines are described in U.S. Pat. Nos. 4,524,749, 3,252,453, 3,207,147, 3,136,308, 2,877,757, and 2,806,461. In the use of automatic pitching machines of this or a similar type in an enclosed batting cage, a primary consideration is returning balls to the pitching machine after they have been pitched.

In conventional return arrangements, a batting cage is provided with a floor that slopes toward a collection point where they can be returned to the pitching machine manually or automatically by an elevator. Depending upon the texture and hardness of the floor surface, the required slope results in a difference in elevation between the batter's floor level and the collection point of eighteen to twenty-six inches. Further, where an elevator is used to return the balls to the pitching machine, an additional four to eight inches of elevation are necessary to permit turnaround of the elevator belt or chain.

If the batting cage is to be provided on an existing flat floor, without excavation or destruction of the floor, the batting deck must be elevated twenty to thirty inches above the previously existing floor. In order for a batter to access the elevated batting deck, either a new floor must be built up around the cage, or steps must be provided. Where the installation is indoors, ceiling height is sacrified by such requirements.

OBJECTS AND SUMMARY OF THE INVENTION

An object of the present invention is to provide a ball return assembly which obviates the need for a large elevational difference between the ball collection point and the batting deck. By providing such a construction, it is possible to reduce the height of the batter's deck above an existing flat floor and to present a batting cage having a neat appearance.

The ball return assembly in accordance with the present invention includes a conveyor and ball guide means for guiding balls within the cage onto the conveyor. The conveyor is adapted to return balls to a pitching machine and includes an endless loop belt having a transport surface provided with a plurality of spaced depressions each adapted to receive a ball. Belt guiding and supporting means guide and support the belt along a generally horizontal ball return path and drive means are provided for driving the belt along the path.

It is preferred that guide rollers support the ends of the conveyor belt and that tensioning means be provided to exert a predetermined amount of tension on the belt. In addition, the depressions in the belt may be holes passing through the belt and sized so that balls are received therein without projecting so far past the opposing surface of the belt that the balls interfere with the lower run of the belt passing beneath the return path.

Wear plates are preferably provided beneath the edges of the conveyor belt along the ball return path to support the belt as it travels therealong. Also, at the delivery end of the ball return path, the belt is guided upwardly at an angle to the return path so that the balls may be dropped into a collection assembly which returns the balls to the pitching machine.

By this construction, it is possible to provide an assembly which can be employed on an existing flat floor without the need for a significant amount of vertical space between the floor and a batting deck of the cage. In addition, a low profile conveyor employed which is smooth except for the ball carrying holes therein so that very little extra vertical space is required to accommodate the belt.

BRIEF DESCRIPTION OF THE DRAWING

A detailed description of the preferred embodiment of the invention is set forth below with reference to the drawing, in which:

FIG. 1 is a schematic perspective view of a batting cage employing a ball return system in accordance with the invention;

FIG. 4 is a sectional view of the conveyor of the invention taken along line 4—4 of FIG. 3;

FIG. 5 is a sectional view taken along line 5—5 of FIG. 3;

FIG. 6 is a sectional view of a section of length of the conveyor assembly.

DETAILED DESCRIPTION OF THE PREFERRED EMBODIMENTS

Figure 2:
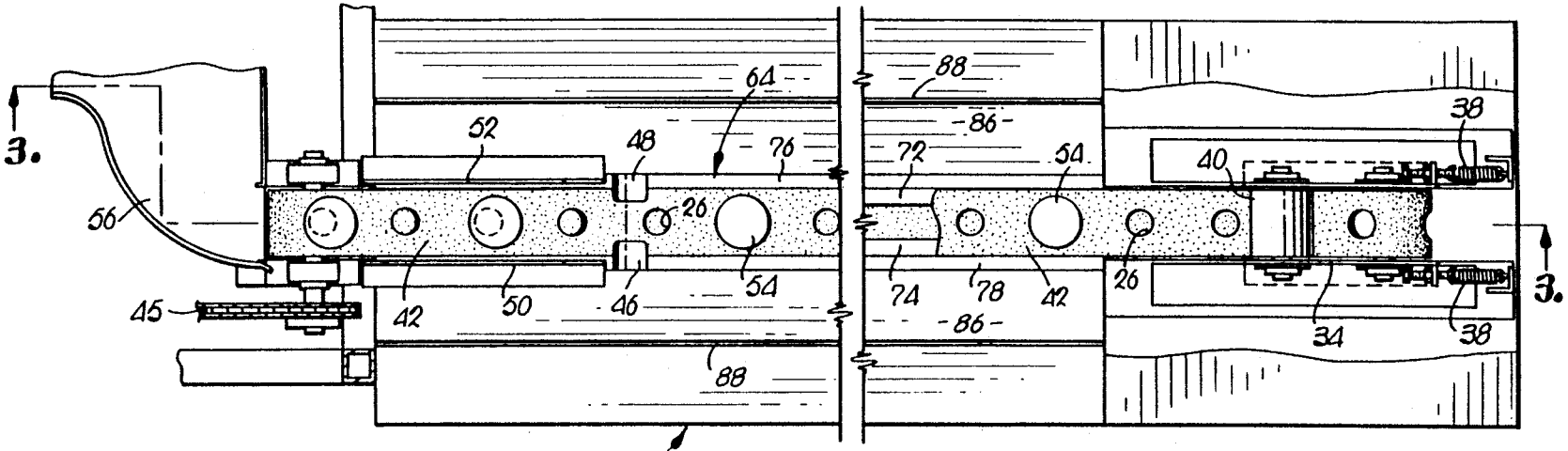
FIG. 2 is a plan view, partly cut away, of the inventive conveyor assembly.

A batting cage employing a ball return assembly in accordance with the present invention is shown in FIG. 1. The cage, designated generally as 10, includes a ball containment net 12 supported by one or more net supporting frames 14. A pitching machine 16, shown schematically, is provided at one longitudinal end of the cage 10 and may be of any known construction such as those discussed in the background. Opposite the pitching machine, a batting deck 18 is disposed and an entrance 20 is provided in the net 12 for permitting access to the cage 10.

A conveyor 22 extends between the batting deck 18 and the pitching machine 16, and includes a belt 24 which travels along a generally horizontal ball return path. The belt 24 includes depressions or holes 26 which are each adapted to receive a ball to be returned to the pitching machine, and is otherwise provided with smooth surfaces so that the thickness of the belt 24 is substantially constant.

In order for balls to be guided onto the belt, a floor 28 is provided in the cage which is angled inwardly toward the belt 24 along the length thereof, and a floor 30 is provided in the batting deck 18 which is angled toward the pitching machine 16. By this arrangement, balls roll along the floors 28, 30 of the cage and deck toward the conveyor belt 24 regardless of where they are in the cage. Further, because the balls are guided to a collection trough or line rather than to a collection point, it is not necessary for the floor 28 of the cage to be continually angled from the batting deck end toward the pitching machine end thereof. Thus, the amount of vertical space required to accommodate the ball guiding floors is minimal.

Figure 3:
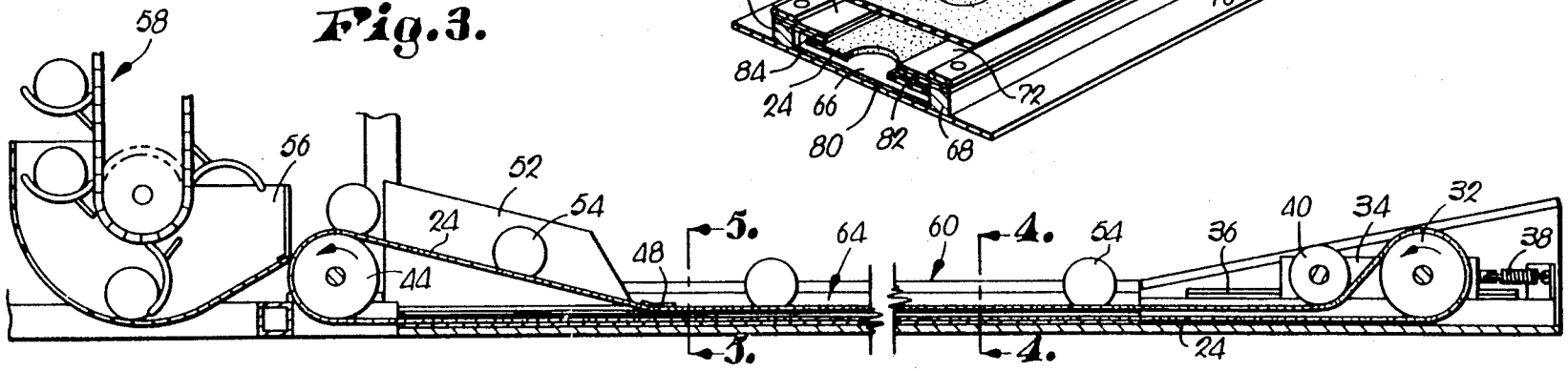
FIG. 3 is a side sectional view taken along line 3—3 of FIG. 2.

The upstream and downstream ends of the conveyor 22 are shown in FIGS. 2 and 3. From FIG. 3, it can be seen that at the upstream end of the conveyor, a first turning roller 32 is provided which is positioned inside the endless loop of the conveyor belt 24 and which serves to reverse the direction of travel of the belt. The turning roller 32 is rotatably supported on a roller support frame 34 which is slidably received in a horizontally disposed track 36. The roller support frame 34 is biased in the upstream direction of the belt 24 by tension springs 38 fastened between the support frame 34 and the track 36. The tension exerted by these springs may be made adjustable to permit compensation to be made for the length of the belt 24 and the load to be carried thereby.

Also mounted on the roller support frame 34 is a guide roller 40 which is rotatably mounted for engagement with the transport surface 42 of the belt. The guide roller 40 serves to reduce the distance between the run of the belt travelling along the ball return path and the run travelling beneath the ball return path. In addition, the guide roller 40 positions the belt vertically with respect to a belt supporting track which is discussed below.

At the downstream end of the conveyor 22, a second turning roller 44 is rotatably mounted on a fixed support and serves to again reverse the direction of travel of the endless loop belt 24. This second turning roller 44 is shown as being connected through a chain 45 to a drive means of any known type such as, e.g. an electric motor which is activated by a coin box switch. A gasoline engine, could alternately be employed.

The second turning roller 44 is positioned in the same horizontal plane as the first turning roller 32 so that the belt 24 must travel vertically upward at the downstream end thereof to pass around the second roller 44. A pair of guide tongues 46, 48 are disposed along the transport surface 42 of the belt 24 near the downstream end of the conveyor and extend inwardly of the belt 24 in a direction perpendicular to the direction of travel of the belt. These tongues 46, 48 are positioned vertically to guide the belt along a ball transport path which is substantially horizontal and which extends between the guide roller 40 and the guide tongues 46, 48. Once a portion of the belt 24 travels past the guide tongues 46, 48, it changes direction and travels along an angled ball delivery path extending between the tongues 46, 48 and the second turning roller 44. A pair of side plates 50, 52 extend upwardly above the transport surface 42 of the belt 24 along the ball delivery path to prevent balls 54 from falling from the belt therealong. As shown in FIG. 3, once the balls 54 being transported by the belt 24 reach the delivery end of the belt, they drop into a collection bin 56 from which they are picked up by a further conveyor 58 and distributed to the pitching machine 16.

Figure 7:
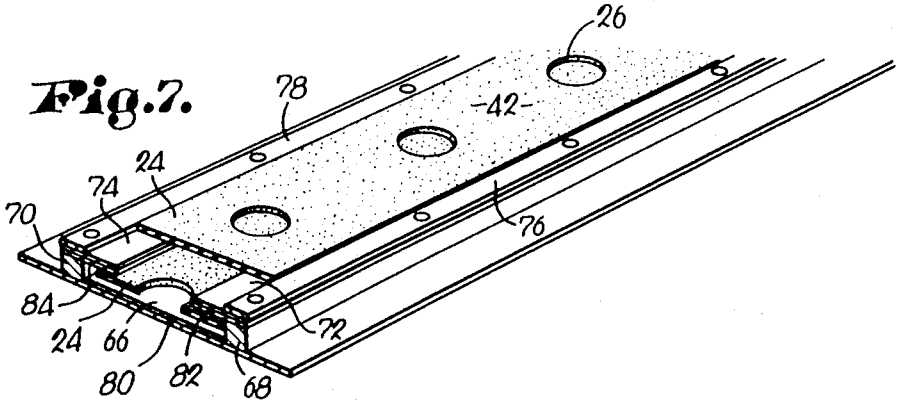
FIG. 7 is a perspective sectional view of a section of length of the conveyor assembly.

The structure of the conveyor 22 and the ball guiding floor 28 of the batting cage is illustrated in FIG. 4. The floor 28 of the cage 10 includes a central longitudinal section 60 on which the conveyor is disposed and two adjacent longitudinal side sections 62. A conveyor track 64 extends along the central section 60 and includes a bottom wear plate 66, two side walls 68, 70, an upper pair of wear plates 72, 74, and a pair of lateral guide strips 76, 78. The portion of the belt travelling along the ball transport path rests on the upper wear plates 72, 74 and is laterally guided by the strips 76, 78. The portion of the belt travelling beneath the ball return path along a belt return path passes between the upper wear plates 72, 74 and the bottom wear plate 66. The upper wear plates 72, 74 further serve to separate the upper and lower runs of the belt so that balls 54 received in the holes 26 of the belt do not contact the lower belt run. In addition, as shown in FIG. 6, the holes 26 in the belt are sized to permit capture of a ball 54 but will not allow a ball to extend through the hole to such an extent that contact is made between the ball 54 and the lower run of the belt. For example, where normal sized baseballs and softballs are to be used in the cage, a hole size within the range of about 1.25 to 2 inches may be employed. A 1.75 inch hole is preferred. The width of the belt may vary, but a width of about 3 to 12 inches is again preferred. Also, the holes 26 formed in the belt are spaced longitudinally by a distance sufficient to ensure that no contact between the balls 54 occurs. The structure of the conveyor track 64 as illustrated in FIGS. 3 and 7 may include support plates 80, 82, 84 or surfaces which underlay the wear plates 66, 72, 74.

Also provided on the central longitudinal section 60 are angled ball guiding surfaces 86 which direct balls onto the belt 24 along the ball return path. Channels 88 or similar means extend along the surfaces 86 and each is adapted to receive and hold one end of a flexible floor material 90. An opposite edge of the material 90 is supported at the sides of the batting cage 10 by any conventional method and is displaced vertically from the lower edge by a distance which will ensure that balls landing on the material will roll onto the belt 24. In this manner, the material forms the two longitudinal side sections 62 of the floor 28.

In FIG. 5, the guide tongues 46, 48 and the second turning roller 44 are shown in a horizontal view illustrating the ball delivery path followed by the belt at the downstream end of the conveyor 22. As mentioned, the primary purpose of the tongues 46, 48 is to maintain the horizontal orientation of the belt 24 along the ball return path. However, the tongues 46, 48 also perform the additional function of ensuring that all balls 54 resting on the belt are guided into one of the holes 26 of the belt. For example, if a ball is travelling along with the belt 24 but is not resting in a hole, the tongue will contact the ball and impede its forward movement until the ball is centered on the belt and thus received by a hole 26. Thereafter, the ball is carried up the sloping delivery path and dropped into the collection bin 56.

Although the invention has been described with reference to a preferred embodiment thereof, it is understood that variations and changes may be made and equivalents employed herein, without departing from the scope of the invention as defined by the claims. For example, any floor construction which provides a sloping surface for guiding balls onto the conveyor may be used, and although only two guide tongues are illustrated, a number of the tongues may be positioned along the ball return path to ensure that the belt is retained in the track and that balls are properly urged toward the holes in the belt. Further, the disclosed system may be employed to provide central ball collection in large, multibatter cages by combining a simple slope to send all balls to the rear of the cage with one or more horizontal conveyors to carry the balls to a central collection point.

What is claimed is:

1. A ball return conveyor apparatus for use with a pitching machine in a batting cage, the conveyor apparatus comprising:

a belt formed into an endless loop and having an outward facing transport surface provided with ball retention means for retaining a plurality of balls on the transport surface during movement of the belt;

a pair of turning rollers each of a predetermined diameter and being positioned inside the endless loop of the belt for supporting the belt for travel along an upper belt run and a lower belt run, the upper belt run defining a ball return path and including upstream and downstream ends;

belt directing means in contact with the transport surface of the belt adjacent the upstream end of the upper run for directing the upper run toward the lower run; and belt redirecting means in contact with the transport surface of the belt adjacent the downstream end of the upper run for redirecting the upper run of the belt away from the lower run of the belt, the belt directing means and the belt redirecting means together positioning the upper run for travel along a horizontal path substantially parallel with the path followed by the lower run along substantially the entire length of the runs at a vertical distance above the lower runs which is less than the diameter of at least one of the turning rollers.

2. The ball return conveyor apparatus as set forth in claim 1, further comprising supporting means for supporting the belt as it travels along the ball return path.

3. The ball return conveyor apparatus as set forth in claim 2, wherein the supporting means includes at least one wear plate in underlying contact with the belt along the ball return path.

4. The ball return conveyor apparatus as set forth in claim 2, wherein the belt includes edge surfaces extending along the ball return path, the supporting means including a pair of wear plates, each of the wear plates being in underling contact with and edge surface of the belt along the length of the ball return path.

5. The ball return conveyor apparatus as set forth in claim 1, further comprising tensioning means for exerting a predetermined amount of tension on the belt.

6. The ball return conveyor apparatus as set forth in claim 1, wherein the ball retention means includes depressions formed in the transport surface of the belt.

7. The ball return conveyor apparatus as set forth in claim 6, wherein the depressions are holes passing through the belt.

8. The ball return conveyor apparatus as set forth in claim 1, wherein the belt redirecting means redirects the belt for travel along a delivery path adjacent the return path and extending vertically at an angle to the ball return path.

9. The ball return conveyor apparatus as set forth in claim 1, further comprising ball guide means for guiding balls within the cage onto the conveyor.

10. The ball return conveyor apparatus as set forth in claim 1, wherein the directing means includes a guide roller that contacts the transport surface of the belt adjacent the upstream end of the upper belt run.

11. The ball return conveyor apparatus as set forth in claim 10, wherein the redirecting means includes structure defining a redirecting surface that contacts the transport surface of the belt adjacent the downstream end of the upper belt run, the redirecting surface redirecting the belt for travel along a delivery path adjacent the return path and extending vertically at an angle to the ball return path.

* * * * *